US006029856A

United States Patent [19]

Jackman

[11] Patent Number: 6,029,856

[45] Date of Patent: Feb. 29, 2000

[54] SELF-PUNCTURING CARTRIDGE NOZZLE

[76] Inventor: Paul D. Jackman, 39 Park St., Hudson, Mass. 01749

[21] Appl. No.: 09/248,425

[22] Filed: Feb. 11, 1999

[51] Int. Cl.[7] ..... B67D 5/00

[52] U.S. Cl. ..... 222/82; 222/83

[58] Field of Search ..... 222/82, 83, 527, 222/541.2

[56] References Cited

U.S. PATENT DOCUMENTS 3,187,918 6/1965 Moore ..... 222/83

4,450,985 5/1984 Beard ..... 222/541.2

5,297,697 3/1994 Boring ..... 222/82

*Primary Examiner*—Philippe Derakshani

*Attorney, Agent, or Firm*—William Nitkin

[57] ABSTRACT

An improved cartridge for holding a variety of filler materials for use with a gun system, such cartridge of the type having a nozzle wherein the foil seal above the filler material in the barrel and beneath the nozzle can be punctured by lateral movement of the nozzle of the cartridge by the user, which action causes a sharpened edge disposed under the innerside of the base of the top under the sidewall of the nozzle to puncture the foil seal.

11 Claims, 4 Drawing Sheets

SELF-PUNCTURING CARTRIDGE NOZZLE

BACKGROUND OF THE INVENTION

1. Field of the Invention

The device of this invention resides in the area of cartridges having nozzles and foil seals located at the bottom of such nozzles, such cartridges containing a variety of filler materials such as caulking material, adhesive and the like, such cartridges, after the top of the nozzle has been opened and the foil seal broken, to be inserted into a gun for the application of its contents through the nozzle when the gun's plunger is advanced by action of its trigger, and more particularly relates to an improved nozzle having built-in means for piercing the foil seal.

2. History of the Prior Art

Cartridges containing a wide variety of flowable material, such as caulking material and adhesives, are well known in the industry. Such cylindrical cartridges have nozzles at their top end and, after opening, such cartridges are inserted into guns wherein a plunger is advanced therein by action of squeezing a trigger, causing material in the cartridge to flow out through the nozzle to the area where it is to be applied. Some cartridges have a foil seal under the nozzle against which seal the material can be positioned. Some materials, if exposed to air, will harden, so that by providing such a seal, air contact with the materials before the cartridge is opened is minimized. To open a cartridge having a foil seal, one must first snip off the tip of the plastic nozzle and then insert an object down the nozzle to puncture the foil seal located at the bottom of the nozzle to allow the passage of the filler material out of the cartridge. It is sometimes difficult to locate a narrow enough instrument to insert down the open nozzle tip to puncture the foil seal. Further, if one snips off the nozzle tip to leave a small diameter opening to achieve a fine application bead of material and one does not have an instrument narrow enough to pass down through the opening in the nozzle to puncture the foil seal, one can undesirably stretch the nozzle tip by using a larger object, making it difficult to apply a narrow bead of material as the now-wider opening in the nozzle tip will allow a wider-than-desired bead of material to pass out the nozzle.

Cartridges filled with a variety of filler materials are commonly sold. The tops of such cartridges including their nozzles are formed of plastic. The top is spun within the barrel to effect a heat seal with the sides of the barrel. The foil seal of a cartridge is located beneath the central bore of the nozzle which foil seal prevents the premature escape of filler material when the cartridge is loaded in the gun and also prevents such material from drying out and hardening within the cartridge. The tip of a cartridge nozzle is often initially sealed and must be snipped off at a desired point along the tapered nozzle to effect the desired shape of opening to create the size of the bead of material which will be applied by the user.

SUMMARY OF THE INVENTION

It is an object of this invention to provide a cartridge for containing various materials having an openable sealed nozzle tip and a foil seal thereunder with self-contained means to puncture such foil seal by lateral movement of the nozzle to allow the passage through the nozzle of the contents of the cartridge.

To accomplish this result, the plastic nozzle top of the cartridge is formed with a concentric series of bellows-like ribs in the base of the top which bellows allow for the lateral bending at an angle of the nozzle. The innermost rib below the sidewall of the nozzle has a downwardly extending sharp edge which can be serrated and which, when the nozzle is pushed laterally, is maneuvered downward at the side of the direction of movement of the nozzle, causing the sharp edge to puncture the foil seal so that the contents of the cartridge can pass through the opened tip of the nozzle for application.

It is a further object of this invention to provide for a unidirectional embodiment wherein the ribs of the bellows extend predominantly along one side of the base of the top around the nozzle in a U-shaped configuration with the sharpened edge disposed on that side and with a pivot groove defined perpendicular to and at the ends of such U-shaped bellows. In use the nozzle is maneuvered perpendicular to the pivot groove, and the pivot groove and bellows allow flexure and movement of the nozzle when it is maneuvered in the direction toward the bellows to cause the sharpened edge to move downward and puncture the foil seal.

It is yet a further object of this invention to provide an improved nozzle top to a cartridge which is molded of plastic which can be easily substituted for prior art nozzle tops during the manufacture of cartridges without any other changes to the product required and which can be entirely molded of one piece of plastic.

DESCRIPTION OF THE PREFERRED EMBODIMENT(S)

Figure 2:
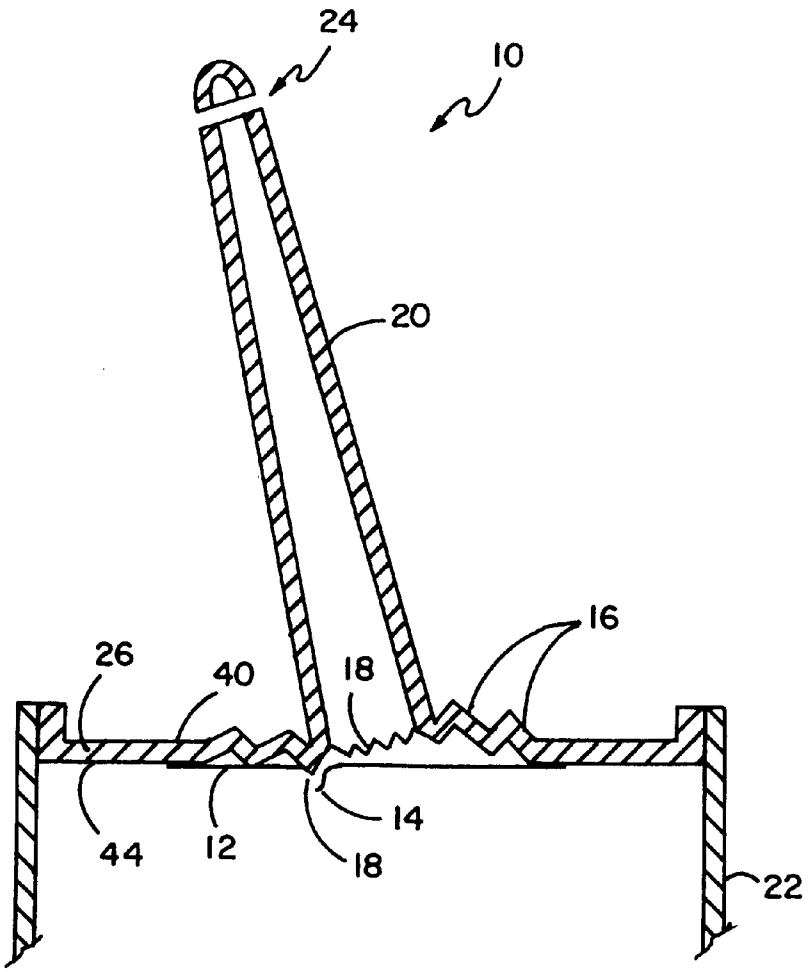
FIG. 2 illustrates the cross-sectional view through the top end of the cartridge tip of FIG. 1 showing the nozzle maneuvered at an angle to effect the puncturing of the foil seal.
Figure 1:
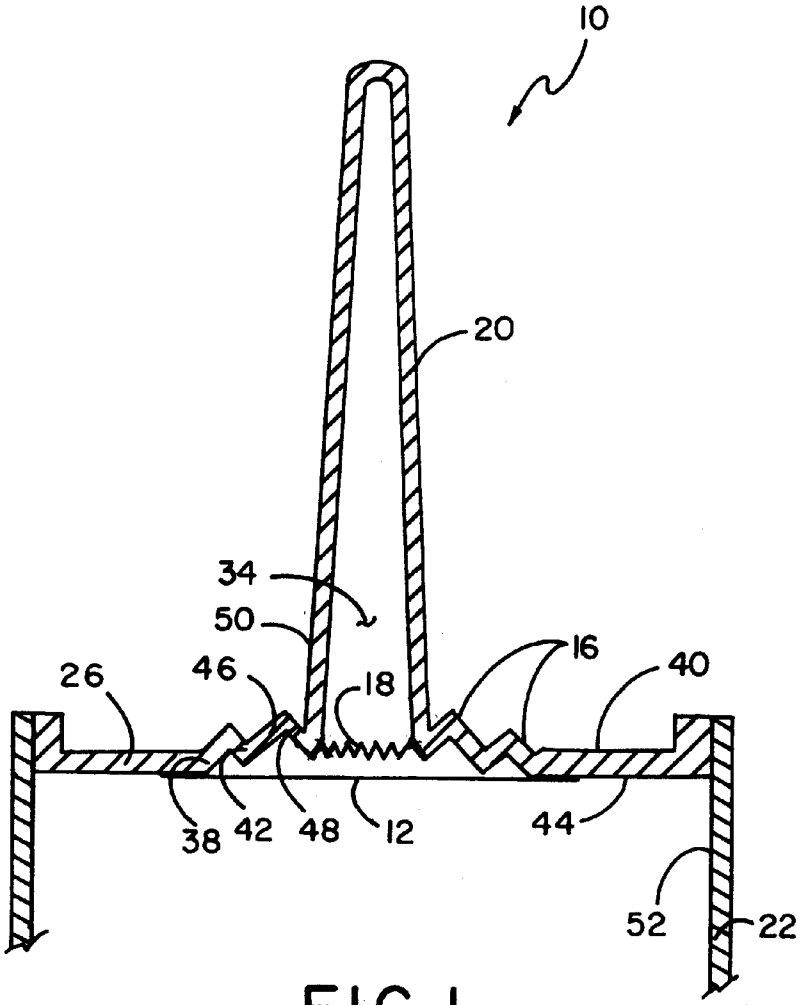
FIG. 1 illustrates a cross-sectional view through the top end of a cartridge embodying the self-puncturing cartridge nozzle structure of this invention.

In FIG. 1 the self-puncturing cartridge nozzle structure of this invention is seen with nozzle 20 disposed above barrel 22 of a cartridge partially shown in a cross-sectional side view. Top 10 is also seen attached to barrel 22. A puncturable foil seal 12 is located under top 10. Seal 12 does not necessarily have to be made of foil and could be made of other material so that when the term "foil seal" is used herein, it should be understood to include seals made of other materials. For purposes of illustration no filler material is shown disposed in barrel 22 of the cartridge in FIGS. 1, 2 and 6. Base 26 of top 10 of this invention, though, differs from the flat bases of the prior art in that a series of bellows 16 made of a plurality of ribs are formed in the base of the top with the center-most rib extending under the bottom perimeter of the sidewall 50 of nozzle 50 around central bore 34. Such center-most rib has sharp edges which can be a singular sharp edge or a plurality of serrations 18 such as seen in FIG. 1. In practice, to puncture foil seal 12 one manually bends nozzle 20 laterally, as seen in FIG. 2, so that serrations 18 cause a puncture 14 in foil seal 12 which nozzle, when released, will snap back to its original position because bellows 16, which are formed as part of base 26 of plastic top 10, are resilient and will cause the nozzle's return to its original vertical position. Only a small puncture is required as the filler material forces the punctured seal to open further as the material is forced therethrough during application of the material. The seal punctures easily as the material therebeneath forms support under the seal preventing the seal from stretching downward away from the sharp edge. The nozzle's tip can be snipped off at a desired angle to form an opening 24 in the top of the nozzle. The invention herein can be easily and economically adopted because the top can be molded of plastic as is currently done, but the mold shape will include the formation of bellows 16 to allow the lateral movement of the nozzle and further will include the formation of a sharp edge 18, such as serrations, as seen in these figures, which can puncture foil seal 12.

Bellows 16 can be formed of a series of ribs molded as part of base 26 of top 10, such as first rib 38 which rises up at an angle of approximately 45 degrees from topside 40 of base 26 and then extends downward at approximately a 90 degree angle to form second rib 42 extending toward innerside 44 of base 26 to a position above seal 12. Third rib 46 then extends upwards at approximately a 90 degree angle from second rib 42 to a point above topside 40 and then extends as fourth rib 48 downward at approximately a 90 degree angle to third rib 46 to sharp edge 18 which is disposed above foil seal 12 and which sharp edge 18 is substantially below sidewall 50 of nozzle 20 into which it continues upwards. By having the sharp edge 18 positioned directly below sidewall 50 of nozzle 20, more force can be applied by the nozzle's lateral movement than if the cutting edge were located on one of the more flexible ribs disposed further out from nozzle sidewall 50. However, the sharp edge could be located further outward in some embodiments of this invention. Seal 12, as shown, extends only under the nozzle and the bellows structure, but it should be noted that in some embodiments it could extend all the way out to side 52 of the cartridge. The base of the top of this invention could have stiffening ribs formed therein which are not shown, if needed in some embodiments, to reduce the flexure of the plastic bellows.

Figure 4:
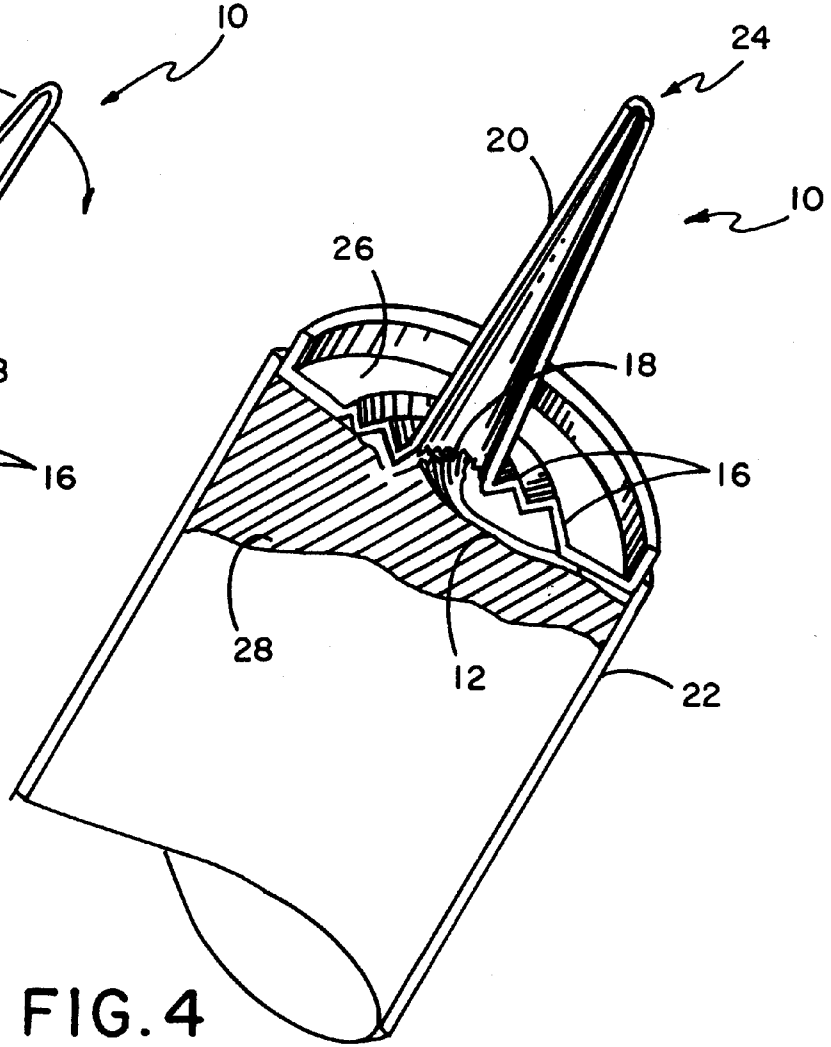
FIG. 4 illustrates a perspective cutaway view of the cartridge of FIG. 3, showing the nozzle moved laterally to cause a puncturing of the foil seal.
Figure 3:
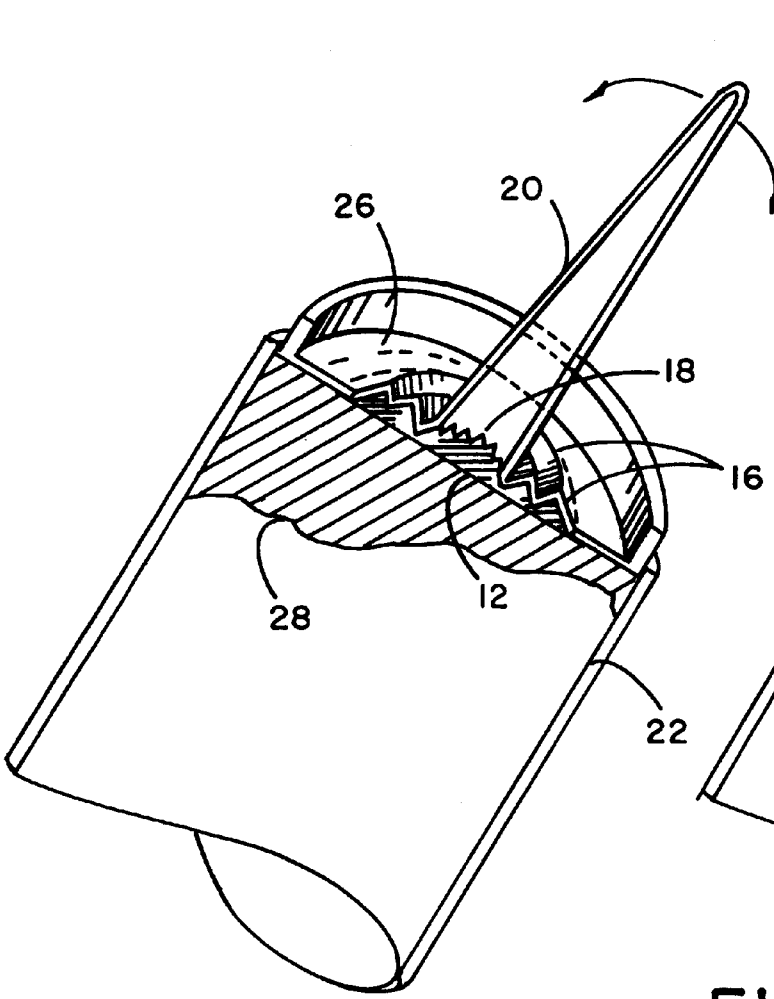
FIG. 3 illustrates a perspective cutaway view of the top end of a cartridge showing the construction of the structure of this invention.

FIG. 3 illustrates a perspective cutaway view of the top end of the cartridge of FIG. 1 further showing filler material 28 held in barrel 22 beneath foil seal 12 which, as nozzle 20 is bent laterally, as seen in FIG. 4, such bending allowed by the distortion of bellows 16 which can be compressed more on one side and stretched somewhat on the other because of its flexible folded nature, causes serrations 18 to puncture foil seal 12, allowing escape of filler material 28 into nozzle 20.

Figure 5:
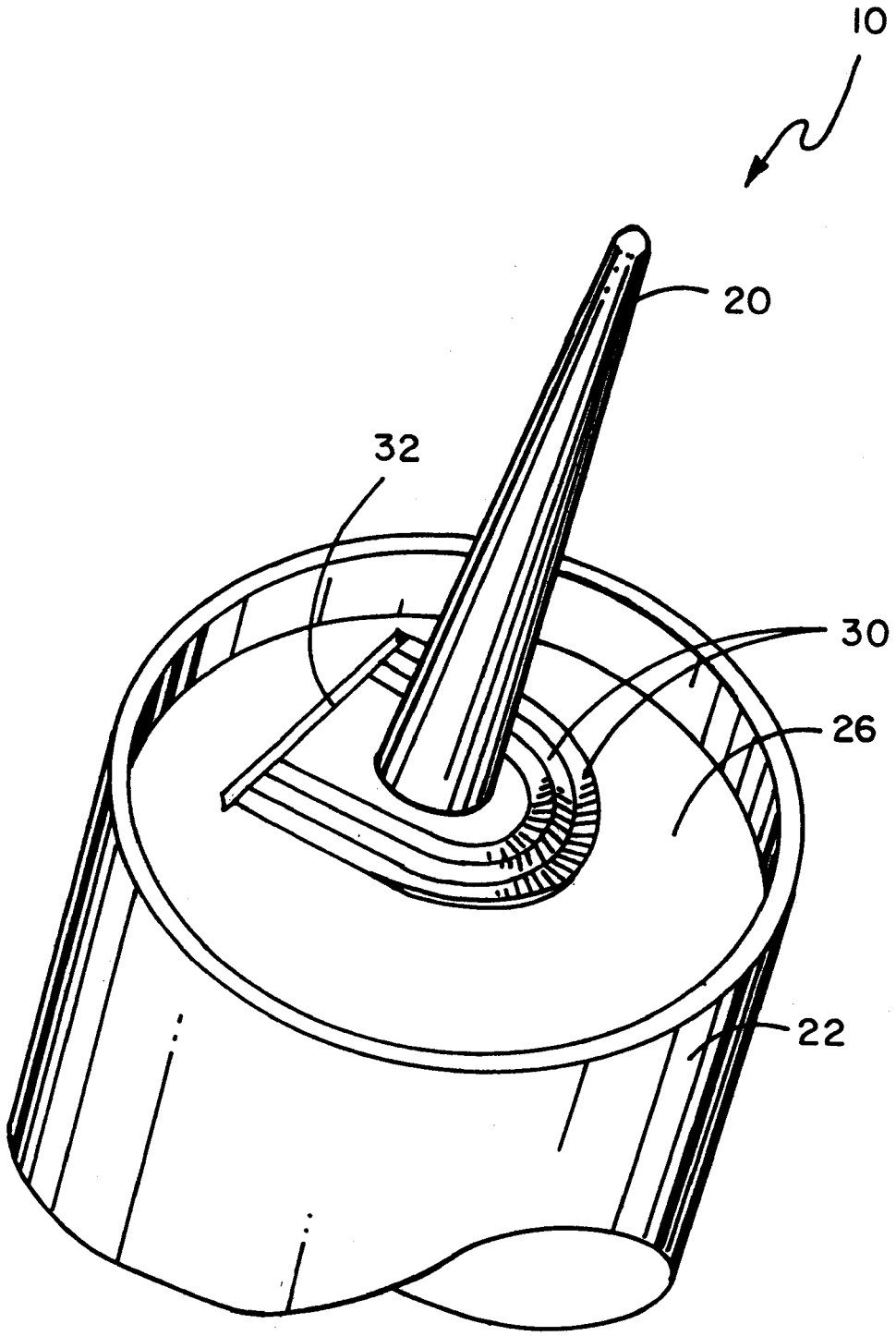
FIG. 5 illustrates a perspective view of an alternate embodiment of the structure of this invention, showing the top end of a cartridge having a unidirectional bellows system to effect the puncturing of the foil seal.

In an alternate embodiment shown in FIG. 5 the bellows can be formed as unidirectional bellows 30 which do not extend concentrically around the nozzle but extend in a U-shaped configuration with its ends at pivot groove 32 which pivot groove formed in topside 40 of base 26 allows for flexure of base 26 during lateral movement of nozzle 20. The bellows in this embodiment are higher, as seen in FIG. 6, on the side opposite pivot groove 32 to allow nozzle 20 to be bent in the direction opposite pivot groove 32 which action compresses bellows 30 and causes sharpened edge 36 to puncture the foil seal under sidewall 50 of nozzle 20.

Figure 6:
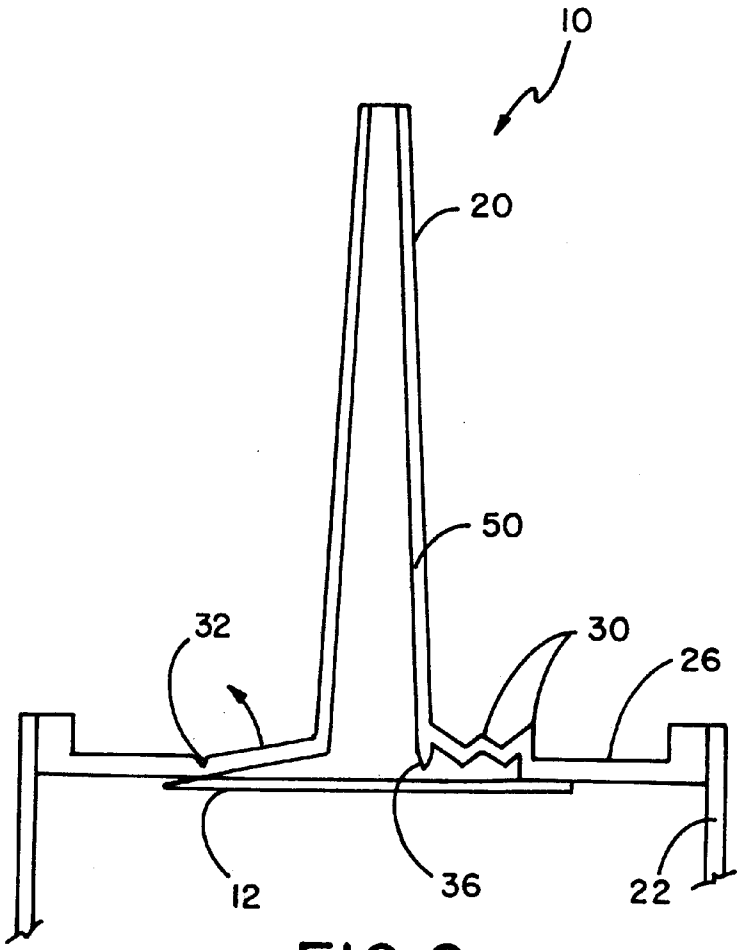
FIG. 6 illustrates a cross-sectional view through the top end of a cartridge having the unidirectional movement nozzle shown in FIG. 5.
Figure 7:
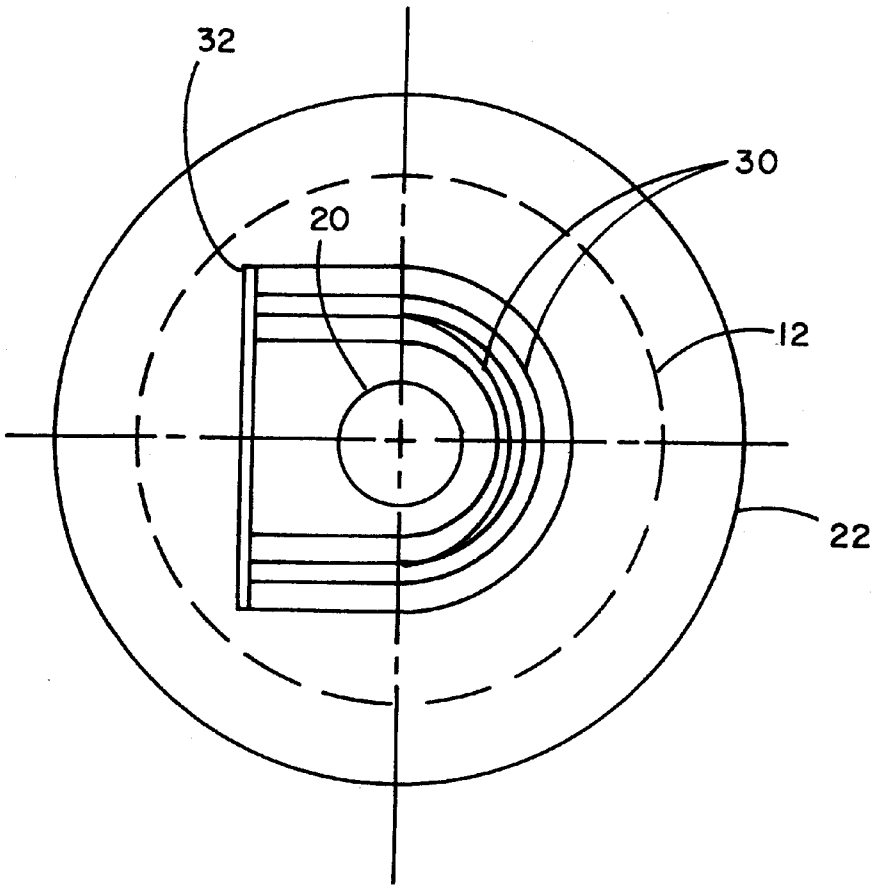
FIG. 7 illustrates a top view of the embodiment as illustrated in FIG. 6.

FIG. 7 illustrates a top view of the structure as seen in FIG. 6 which shows the unidirectional-bending nozzle. It should be noted that the bellows in the unidirectional-bending nozzle embodiment start at a higher point opposite pivot groove 32 and taper in height down to pivot groove 32.

It is felt that the self-puncturing cartridge nozzle structure of this invention is a significant improvement over prior art cartridge nozzles as the user would no longer have to locate an object to insert down through opening 24 in the nozzle, as seen in FIGS. 2 and 4, to puncture the foil seal and the user can quickly and easily puncture the foil seal by a rapid lateral manipulation of the nozzle which nozzle can now be easily moved due to the flexible bellows formed in the base of the top of the cartridge.

It should be noted that in some embodiments only a sharpened protruding edge can be disposed around the innerside of the base of the nozzle which can be forced through the foil seal by a lateral movement of the nozzle.

Although the present invention has been described with reference to particular embodiments, it will be apparent to those skilled in the art that variations and modifications can be substituted therefor without departing from the principles and spirit of the invention.

I claim:

1. An improved cylindrical cartridge of the type having a top, said top having a nozzle with a sidewall and a central bore defined therein, a base with a topside and an innerside, and a barrel, wherein said nozzle is initially closed at the top of said cartridge, said cartridge having filler material disposed in said barrel and a puncturable seal disposed under said nozzle on said innerside of said base, said puncturable seal preventing the escape of said filler material from said barrel, comprising:

puncturing means disposed in said base of said nozzle for puncturing said seal, said means operative by lateral movement of said nozzle by a user.

2. The device of claim 1 wherein said puncturing means include a sharpened portion formed on said innerside of said base, said sharpened portion maneuverable to puncture said seal upon the lateral bending of said nozzle.

3. The device of claim 2 wherein said sharpened portion is formed of said innerside of said base beneath said sidewall of said nozzle.

4. The device of claim 3 wherein said base includes means to facilitate the lateral bending of said nozzle.

5. The device of claim 4 wherein said means to facilitate the lateral bending of said nozzle comprises at least one bellows formed in said base, said bellows having a sharpened portion disposed on said innerside of said base beneath said sidewall of said nozzle.

6. The device of claim 5 further including a plurality of ribs formed in said bellows in said base of said top of said cartridge.

7. The device of claim 6 further including means for unidirectionally bending said nozzle.

8. The device of claim 7 wherein said bellows extend in a U-shaped configuration around said nozzle, said U-shaped bellows having ends, said device further including:

a linear pivot groove formed in said topside of said base, said pivot groove disposed perpendicular to and at said ends of said U-shaped bellows, said pivot groove for allowing flexing of said base when said nozzle is bent in a direction perpendicular to said pivot slot.

9. The device of claim 6 wherein said ribs of said plurality of said bellows extend concentrically around said nozzle and to one another.

10. The device of claim 6 wherein said sharpened portion extends around the entire base under said sidewall of said nozzle.

11. The device of claim 10 wherein said sharpened portion is serrated.

* * * * *